US006549731B1

(12) United States Patent
Yoshida et al.

(10) Patent No.: US 6,549,731 B1
(45) Date of Patent: Apr. 15, 2003

(54) IMAGE FORMING APPARATUS

(75) Inventors: Tomofumi Yoshida, Hitachi (JP); Masahiko Saito, Kitaibaraki (JP); Akira Sasaki, Hitachi (JP); Koichi Sato, Hitachinaka (JP); Satoshi Narita, Hitachioota (JP); Yoshitaro Ishii, Hitachi (JP)

(73) Assignee: Hitachi, Ltd., Tokyo (JP)

( * ) Notice: Subject to any disclaimer, the term of this patent is extended or adjusted under 35 U.S.C. 154(b) by 0 days.

(21) Appl. No.: 09/644,070

(22) Filed: Aug. 23, 2000

(30) Foreign Application Priority Data

Aug. 30, 1999 (JP) ..... 11-242699

(51) Int. Cl.[7] ..... G03G 15/00
(52) U.S. Cl. ..... 399/12; 399/119
(58) Field of Search ..... 399/12, 119, 110, 399/223, 13

(56) References Cited

U.S. PATENT DOCUMENTS 4,697,915 A * 10/1987 Hayashi et al.
4,839,691 A * 6/1989 Tagawa et al. ..... 399/12
4,912,512 A * 3/1990 Midorikawa et al. ..... 399/12
4,937,626 A * 6/1990 Kohtani et al. ..... 399/12
4,949,399 A * 8/1990 Williams et al. ..... 399/119
5,289,243 A * 2/1994 Sakamoto ..... 399/119
5,392,102 A * 2/1995 Toyoizumi et al. ..... 399/223 X
5,862,430 A * 1/1999 Mitekura et al. ..... 399/13
6,070,029 A * 5/2000 Nishiuwatoko et al.
6,137,966 A * 10/2000 Uehara et al. ..... 399/13
6,347,195 B1 * 2/2002 Saiki et al. ..... 399/12

FOREIGN PATENT DOCUMENTS

JP 60-230169 * 11/1985
JP 11-161016 * 6/1999

* cited by examiner

*Primary Examiner*—Susan S. Y. Lee
(74) *Attorney, Agent, or Firm*—Antonelli, Terry, Stout & Kraus, LLP

(57) ABSTRACT

An image forming apparatus is capable of preventing with certainty the loading of a developing device an incorrect loading portion from being operated. The image forming apparatus includes a latent image holding body forming an electrostatic latent image, a developing device developing the electrostatic latent image to form a visible toner image, the developing device being detachably loaded in the image forming apparatus, a transfer device transferring the developed image onto a printing medium and a fixing device for fixing the transferred image. The image forming device can prevent an incorrect developing device loading in the image forming apparatus from being placed in a development enabled condition and can detect an active state of prevention.

4 Claims, 7 Drawing Sheets

FIG. 5(a-1)
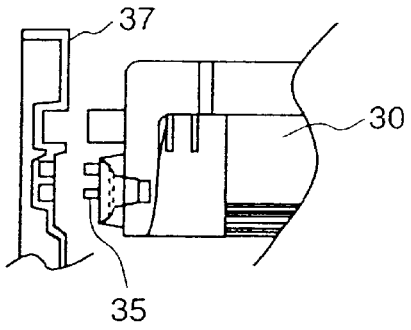
FIG. 5(a-2)
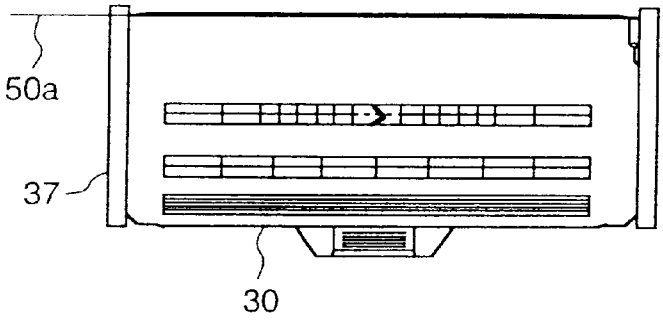
FIG. 5(b-1)
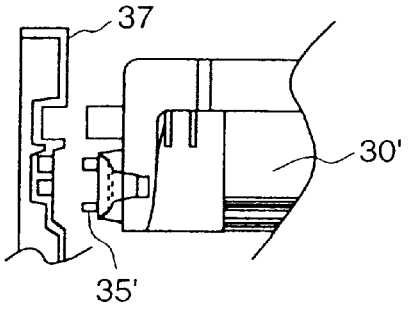
FIG. 5(b-2)
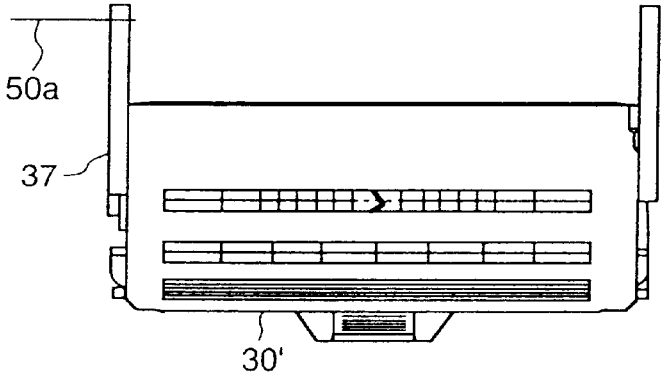
FIG. 5(c-1)
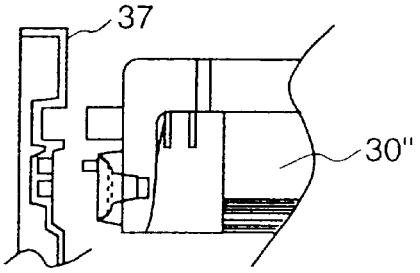
FIG. 5(c-2)
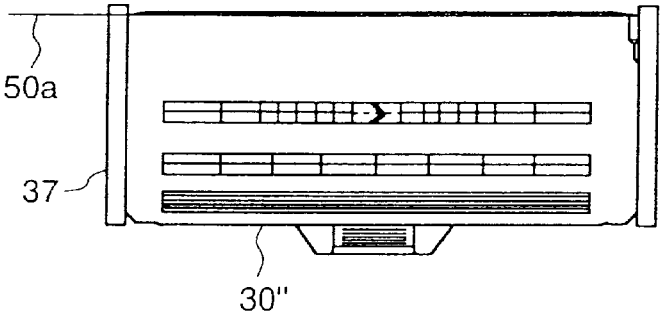

IMAGE FORMING APPARATUS

BACKGROUND OF THE INVENTION

The present invention relates in general to an image forming apparatus. More particularly, the invention relates to an image forming apparatus of the type which has a developing device that is installed detachably and, thus, is suitable for feeding toner, as well as replacing the toner cartridge or the developing device.

Conventionally, in an image forming apparatus which operates by forming an electrostatic latent image on a photosensitive body, a developing device is provided in order to make the electrostatic latent image visible by applying a toner thereto. The developing device is installed in the image forming apparatus mainly for feeding the toner, and is typically detachably mounted for facilitating replacement or maintenance of the developing device.

When this kind of image forming apparatus is manufactured as an original-equipment manufacturer (OEM) product to be sold under various brands by a plurality of different companies, it is required to provide constructions for the toner cartridge and/or developing device to permit loading only of the image forming apparatus of the corresponding brand (which will be hereinafter referred to as "providing non-compatibility" for the toner cartridge and/or the developing device).

Conventionally, the external shape of the developing device varies significantly per brand, and the loading portion of the developing device in a main body of the image forming apparatus is designed to make it impossible to load a developing device of a brand other than the specific or designated brand of the image forming apparatus for the purpose of providing non-compatibility with other brands. However, in case of an image forming apparatus to be provided for sale under a plurality of brands, it becomes necessary, if non-compatibility is provided, to manufacture developing devices each having a different shape for each brand, which will inherently result in an increase of the manufacturing cost of the developing device and to make manufacture, storage, handling and so forth of the developing device quite troublesome.

On the other hand, Japanese Patent Application Laid-Open No. 7-134497 (1995) discloses an image forming apparatus provided with a simple electrical signal relay means in order to detect loading of a particular kind of developing device in the main body of the image forming apparatus.

Also, in case of a full color image forming apparatus of this kind, for example, typically four developing devices respectively using toners of yellow, magenta, cyan and black, or three kinds of developing devices respectively using toners of yellow, magenta and cyan are provided. To accommodate these developing devices of different colors, the image forming apparatus is provided with a plurality of developing device loading portions. In many cases, the positions accommodating the respective developing devices of different colors are fixed in the image forming apparatus. In such a case, the developing devices of the respective colors have to be loaded at the correct loading portions. For example, in the case of the yellow developing device, steps need to be taken so that this developing device will not be loaded in the loading portion for a developing device of another color in the image forming apparatus. The same is true for the developing devices of the other colors. Namely, non-compatibility has to be provided for the plurality of developing devices to be loaded in the same image forming apparatus. Even for an image forming apparatus other than one of the full color type, when a plurality of kinds (two or more kinds) of developing devices are used in the image forming apparatus and the respective loading portions of the respective developing devices are fixed, non-compatibility has to be provided for the respective developing devices.

In a former restricting means, by differentiating on the basis of external shape, when a member to be engaged is employed as the restricting means, the restricting means can be rendered ineffective by removing an engaging portion of the engaging member or by removing the engaging member itself. Also, in the case of the arrangement disclosed in Japanese Patent Application Laid-Open No. 7-134497 (1995), detection of loading of the developing device is performed by means of a connector, which is provided at a position where it will not mate with the engaging member, and with use of a simple electric signal relay member. Therefore, when the developing device, from which the engaging portion or the engaging member per se has been removed, is not the correct one to be loaded in the relevant loading portion, it is possible to make an erroneous detection that the correct developing device has been loaded, thereby to permit operation of the developing device under unfavorable conditions.

On the other hand, in such a device, when the simple electric signal relay member is constantly short-circuited, the main body of the image forming apparatus may detect that a correct developing device has been loaded, even when a developing device has not been loaded.

SUMMARY OF THE INVENTION

It is therefore an object of the present invention to provide an image forming apparatus which can solve the problem set forth above.

More particularly, an object of the present invention is to provide an image forming apparatus which can certainly prevent the loading of a developing device at an incorrect loading portion and/or prevent that developing device from being operated.

Another object of the present invention to provide an image forming apparatus which can certainly prevent a main body thereof from causing an erroneous detection that a correct developing device has been loaded, while in fact, a developing device has not been loaded, but appears to be so due to short circuiting of an electric signal relay member by something other than the developing member.

According to the one aspect of the present invention, an image forming apparatus comprises: a latent image holding body forming an electrostatic latent image; a developing device developing the electrostatic latent image to form a visible developed image using a toner, the developing device being detachably loaded in the image forming apparatus; a transfer device transferring a developed image onto a printing medium; a fixing device for fixing the transferred image; means for preventing an incorrect developing device which has been loaded in the image forming apparatus from being placed in a development enabled condition; and means for detecting the operating state of the preventing means.

According to another aspect of the present invention, an image forming apparatus comprises: a latent image holding body forming an electrostatic latent image; a developing device developing the electrostatic latent image to form a visible developed image using a toner, the developing device being detachably loaded in the image forming apparatus; a transfer device transferring the developed image onto a printing medium; a fixing device for fixing the transferred image; a main body of the image forming apparatus incorporating at least the latent image holding body; an engaging member, mounted on one of the main body of the image forming apparatus and the developing device, identifying the kind of developing device; an engagement receptacle member mounted on the other of the main body and the image forming apparatus, the engagement receptacle member being engageable with the engaging member when the developing device loaded in the image forming apparatus is other than a predetermined kind of developing device; and an electrical signal relaying member to be opened and closed by the engaging member during operation of the developing device.

In a case where the image forming apparatus is supplied as an original-equipment manufacturer (OEM) product to be sold under various commercial brands, and the developing devices and other consumable supplies are supplied exclusively for a corresponding commercial brand of image forming apparatus, it is preferred that the preventing means be capable of operation only upon loading of the developing device of correct manufacture or correctly corresponding commercial brand.

In the preferred construction, the image forming apparatus may further comprise a detecting device for detecting the presence or absence of the developing device in a redundant manner for restricting the operation of the image forming apparatus under a non-loaded condition of the developing device. The detecting means may be provided in a loading portion of the developing device in a main body of the image forming apparatus and designed to be electrically opened and closed only upon operation of the developing member. When the image forming apparatus is loaded with a plurality of developing devices, the detecting means detects the variation of one electrical signal as an output of a plurality of detecting means connected in parallel.

Also, when the image forming apparatus employs a plurality of developing devices storing a plurality of toners mutually distinct colors, the preventing means may prevent loading of the developing device of a color other than a predetermined correct color.

Preferably, the image forming apparatus is designed so that the arrangement for ensuring loading of a correct developing device as set forth above, may not be easily overridden. Thus, operation of the image forming apparatus under a condition where the developing device is not loaded can be certainly prevented.

BRIEF DESCRIPTION OF THE DRAWINGS

The present invention will be understood more fully from the detailed description given hereinafter and from the accompanying drawings of the preferred embodiment of the present invention, which, however, should not be taken to be limitative to the invention, but are for explanation and understanding only.

In the drawings:

FIGS. 5(*a*-1), 5(*b*-1) and 5(*c*-1) are side elevations and FIGS. 5(*a*-2), 5(*b*-2) and 5(*c*-2) are plan views showing a relationship of engagement between a developing device loading portion of the preferred embodiment of the image forming apparatus and an engaging member on the developing device, and how the developing device of different kind can be loaded by removing an engaging portion;

DETAILED DESCRIPTION OF THE PREFERRED EMBODIMENTS

The present invention will be discussed hereinafter in detail in terms of a preferred embodiment of a full color image forming apparatus according to the present invention with reference to the accompanying drawings. In the following description, numerous specific details are set forth in order to provide a thorough understanding of the present invention. It will be obvious, however, to those skilled in the art that the present invention may be practiced without these specific details. On the other hand, well-known structure is not shown in detail in order to avoid unnecessary obscurity of the present invention.

Figure 7:
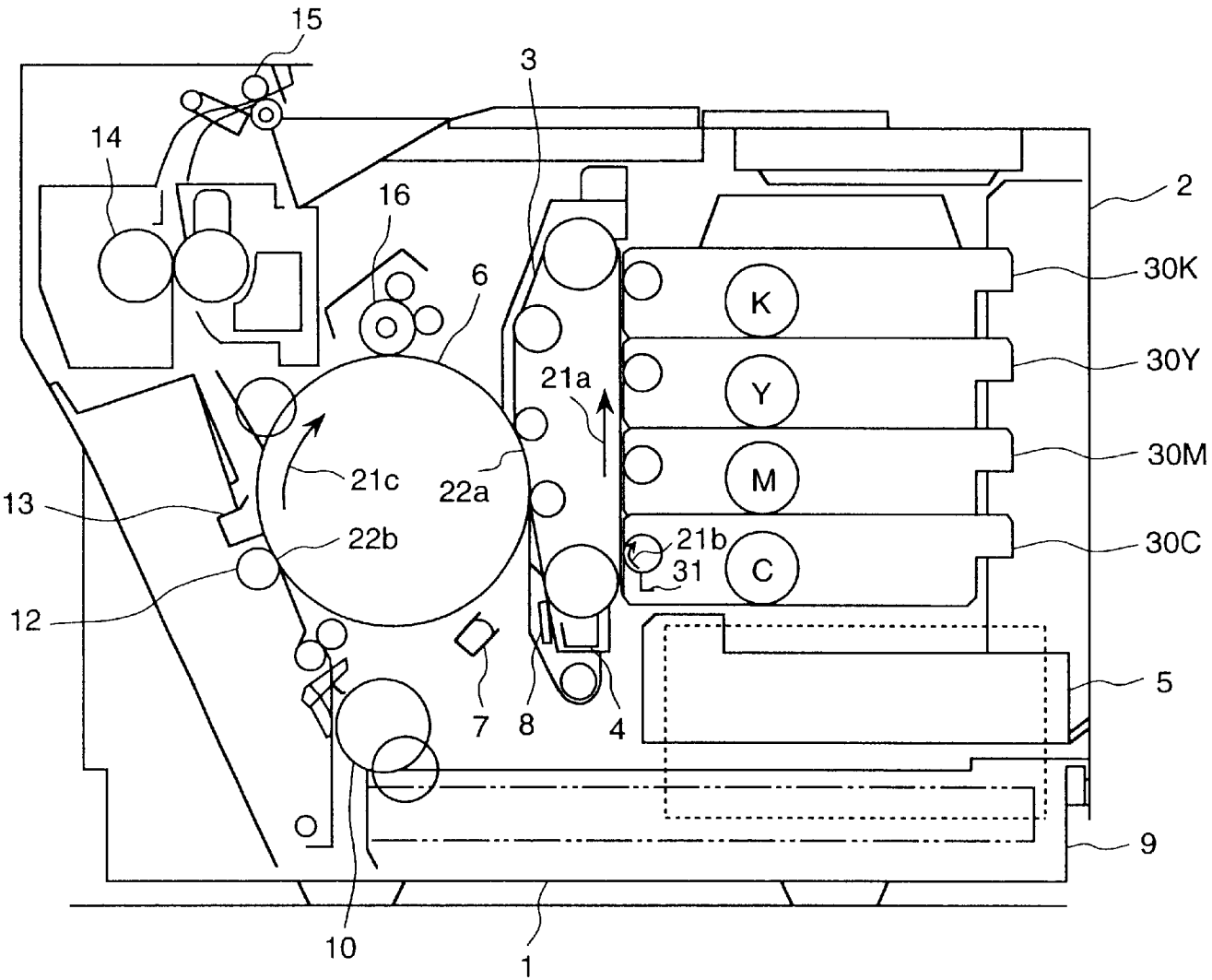
FIG. 7 is a longitudinal section of the preferred embodiment of the color image forming apparatus.

FIG. 7 is a sectional side elevation of the preferred embodiment of a compact color image forming apparatus according to the present invention.

A color image forming apparatus 1 is constructed by arranging a vertically elongated annular photosensitive belt 3, serving as latent image holding means, at a center portion of an outer casing 2 formed as a machine casing, and arranging a transfer drum 6 operating as an intermediate transfer body, a transfer device, a feeding device of a printing medium and a fixing device 14 on the left side of the photosensitive belt, and developing devices 30K, 30Y, 30M and 30C filled with toners of four different colors on the right side, as seen in the drawing.

Below the developing device 30*c*, an exposure device 5 for forming the latent image is arranged. Furthermore, below the exposure device 5, a paper feeding cassette 9 for holding the printing medium is arranged.

Around the transfer drum 6, the transfer device 12, a printing medium peeling off device 13, and an intermediate transfer body cleaning device 16 are arranged. On the other hand, around the photosensitive belt 3, a charging device 4, a residual image erasing device 7 and a cleaning device 8 are arranged.

The photosensitive belt 3 is driven by a driving device (not shown) to circulate in a direction shown by an arrow 21*a*. A photosensitive layer on the surface of the circulating photosensitive belt 3 is initially charged uniformly by the charging device 4. Next, by means of the exposure device 5, the photosensitive belt 3 is exposed per dot according to printing information, such as character information, image information or so forth generated by a personal computer, an image scanner and so forth for forming an electrostatic latent image on the surface of the photosensitive belt 3. Subsequently, the electrostatic latent image on the surface of the photosensitive belt 3 is developed by selectively using one of the developing devices 30K, 30Y, 30M and 30C for forming a toner image.

The photosensitive belt 3, after passing through a first transfer position 22*a*, where the toner image thereon is transferred to the transfer drum 6, is erased so as to remove any electrostatic latent image thereon by uniformly irradiating the surface thereof with a light beam from a residual image erasing device 7 to lower the surface potential to a value lower than or equal to a given level. Subsequently, any residual toner left on the surface of the photosensitive belt that has not been transferred in the first transfer operation at the first transfer position 22*a* is removed by the cleaning device 8 for cleaning the surface of the photosensitive belt 3, so that it will be ready for formation of the next toner image.

By sequentially performing the foregoing one cycle of operation of toner image formation and transfer in synchronism with a timing of one turn of the transfer drum 6, while selectively using the developing devices 30K, 30Y, 30M and 30C, a multi-color toner image, on which a plurality of single color images are superimposed, is formed on the surface of the transfer drum.

On the other hand, the printing medium, such as a sheet of printing paper, an OHP sheet or the like, is fed to a second transfer position 22*b* from a feeding device 10, where the single color or multi-color toner image formed on the surface of the transfer drum 6 is transferred onto the surface of the printing medium by operation of the transferring device 12. The printing medium, on which the toner image is transferred from the transfer drum 6 is peeled off the transfer drum 6 by the printing medium peeling off device 13. Then, the toner image is fixed on the printing medium by the fixing device 14. At this point, the printing product is delivered into a paper tray on the upper surface of the outer casing 2 of the main body by a paper-ejecting device 15.

After transferring the toner image onto the printing medium, the residual toner left on the surface of the transfer drum 6 is cleaned by the intermediate transfer body cleaning device 16 to get ready for the transfer of the next toner image from the photosensitive belt 3.

By simplification of the transporting path of the printing medium from feeding to ejection and providing a large radius for the transporting path, paper jamming during transporting can be prevented so as to improve the reliability of the apparatus. Furthermore, even if a paper jam occurs, steps for resolving the paper jam can be performed easily. Furthermore, by designing the transporting path as set forth above, the present invention is applicable to use of a plurality of different kinds of printing medium in the image forming apparatus, such as cardboard or the like.

In the above-described embodiment, by forming the printing medium transporting path with a substantially arc-shaped configuration and by arranging the transfer drum 6, the photosensitive belt 3, the developing devices 30K, 30Y, 30M and 30C and the exposure device 5 inside of the arc-shaped printing medium transporting path, the space in the outer casing 2 of the main body can be effectively used to permit down-sizing of the outer casing, simplification of the transporting path, and the ability to deliver the printing medium with its printed side oriented downwardly.

By employing the construction as set forth above, the transporting path can be simplified. Furthermore, by arranging most of the component units inside of the arc-shaped transporting path, the transporting path can be located close to the outer casing to facilitate opening of the transporting path, thereby to facilitate the steps that need to be taken upon occurrence of a paper jam. On the other hand, by delivering the printing medium onto the outer casing of the main body with the printed face being oriented downwardly, the printing media ejected and stacked on the outer casing 2 of the main body will be sorted automatically in the order of printing.

On the other hand, by forming the latent image holding body in the form of a photosensitive belt 3 circulating along a substantially elliptic path so that the photosensitive belt 3 may move linearly in the developing region, a plurality of developing devices 30K, 30Y, 30M and 30C having substantially the same shape can be arranged in an array disposed opposite to the linear region of the photosensitive belt 3. Thus, the productivity of the developing devices 30K, 30Y, 30M and 30C can be enhanced. Furthermore, a switching mechanism for selectively using one of the developing devices 30K, 30Y, 30M and 30C for the color to be developed can be simplified, thereby to contribute to a down-sizing and a lowering of the price of the apparatus. On the other hand, by arranging the photosensitive belt in a vertically elongated form, the area to be occupied by the photosensitive belt can be made smaller, in comparison with the case where the photosensitive belt is arranged in a different manner, thereby to further contribute to a down-sizing of the outer casing 2 of the main body.

When the printing medium is transported from the lower portion to the upper portion in the outer casing 2, the transfer drum 6 is rotated in the direction shown by the arrow 21*c*, and the photosensitive belt 3 is circulated in the direction shown by the arrow 21*a*, so that the directions of motion at each contact point between the transfer drum 6 and the photosensitive belt 3 are the same, thereby to restrict the magnitude of vibration or the like as much as possible. Also, by adopting a construction in which the transfer drum comes into contact with the photosensitive belt 3 under pressure to make the photosensitive belt 3 circulate so as to follow the rotation of the transfer drum 6, transfer of the toner image can be effected without causing a color drift. At this time, for example, by employing a reverse rotation developing system (system for circulating from the lower side to the upper side on the side of the photosensitive belt), in which a developer roll 31, operating as a toner carrier of the developing device 30C, is driven to rotate in the direction shown by an arrow 21*b*, mating surfaces of the photosensitive belt 3 and the developer roll 31 can be driven in the same direction to achieve a high developing efficiency, while restricting the magnitude of vibration as much as possible.

It should be noted that the detailed construction of the electrophotographic image forming apparatus or the electrophotographic printer set forth above has been disclosed in commonly owned U.S. Pat. No. 5,555,074 to Haragakiuchi et al. and commonly owned U.S. Pat. No. 6,081,683 to Miyasala et al., for example. The disclosures of the above-identified U.S. Patents are hereby incorporated by reference.

Next, restricting means for preventing loading of a developing device, other than a particular kind or brand of the developing device which is the correct developing device to be loaded, and detecting means for detecting the restricting means in operation, will be described as one embodiment of the present invention.

Figure 6:
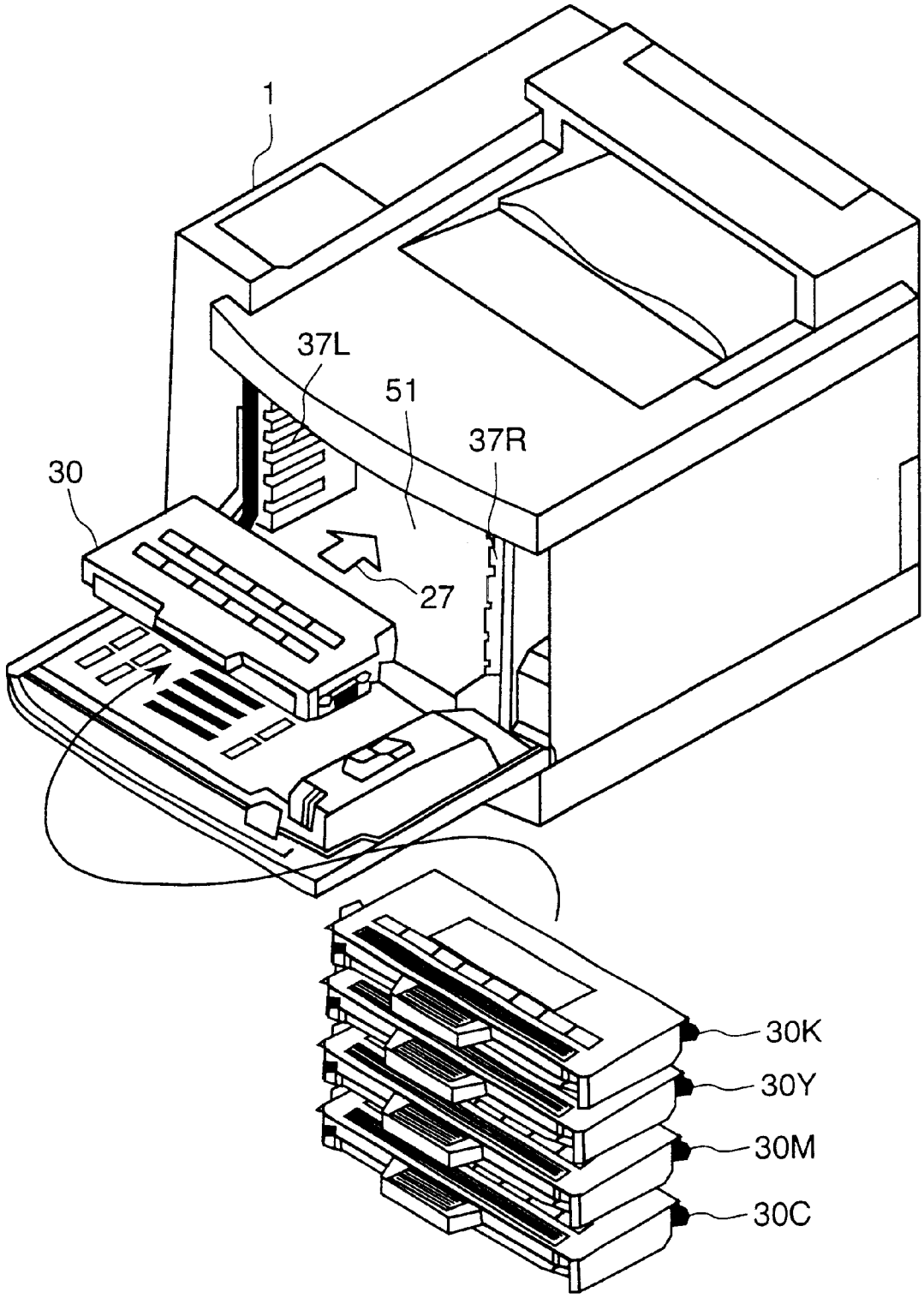
FIG. 6 is a perspective view of the image forming apparatus in a condition where the developing device loading opening is being loaded with a developing device in the preferred embodiment of a color image forming apparatus.

FIG. 6 is a perspective view showing a condition where a developing device loading and unloading opening 51 of the image forming apparatus 1 is opened. In the developing device loading and unloading opening 51 of the image forming apparatus 1, guides 37 are provided on the lateral interior surfaces for guiding and supporting a developing device 30 to be loaded and unloaded. The developing device 30 is inserted in a direction shown by arrow 27 for loading it in the image forming apparatus 1.

Figure 4:
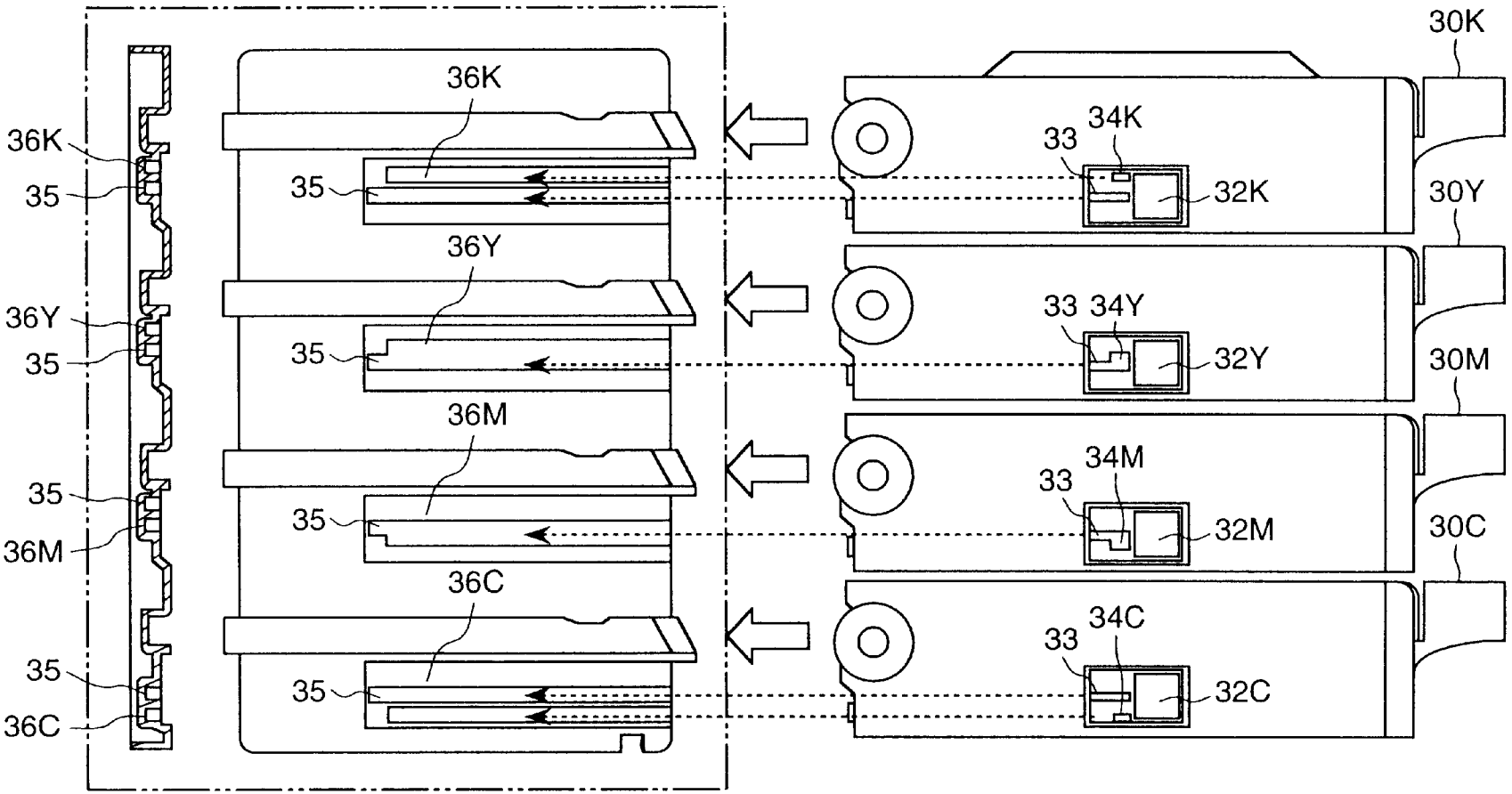
FIG. 4 is a front elevation showing engagement between a developing device loading portion of the preferred embodiment of the image forming apparatus and an engaging member on the developing device.

As shown in FIG. 4, each developing device 30 has an engaging member, which is located at a different position depending upon the brand of the image forming apparatus 1 to be loaded and the toner color of the developing device. In the following discussion, the engaging member will be referred to as "key" 32, a brand corresponding key will be referred to as a "customer key" 33 and a color corresponding key will be referred to as a "color key" 34. On the other hand, in the guides 37, a customer groove 35 and a color groove are provided which respectively engage with the customer key 33 and the color key 34 upon loading the developing device 30.

As shown in FIG. 5(*a*-1), the developing device 30, which matches both the required brand and color hue, is pre-loaded up to a developing device stand-by position 50*a*, while being restricted by the guides 37, as shown in FIG. 5(*a*-2). On the other hand, when the developing device 30' does not match at least one of the brand and color hue as shown in FIG. 5(*b*-1), it cannot be pre-loaded up to the developing device stand-by position 50*a*, but is blocked, as shown in FIG. 5(*b*-2). However, the developing device 30" for a different brand, in which the customer key 35' has been removed from the developing device 30', as shown in FIG. 5(*c*-1), can be pre-loaded up to the developing device stand-by position 50*a*, as shown by FIG. 5(*c*-2).

Figure 1B:
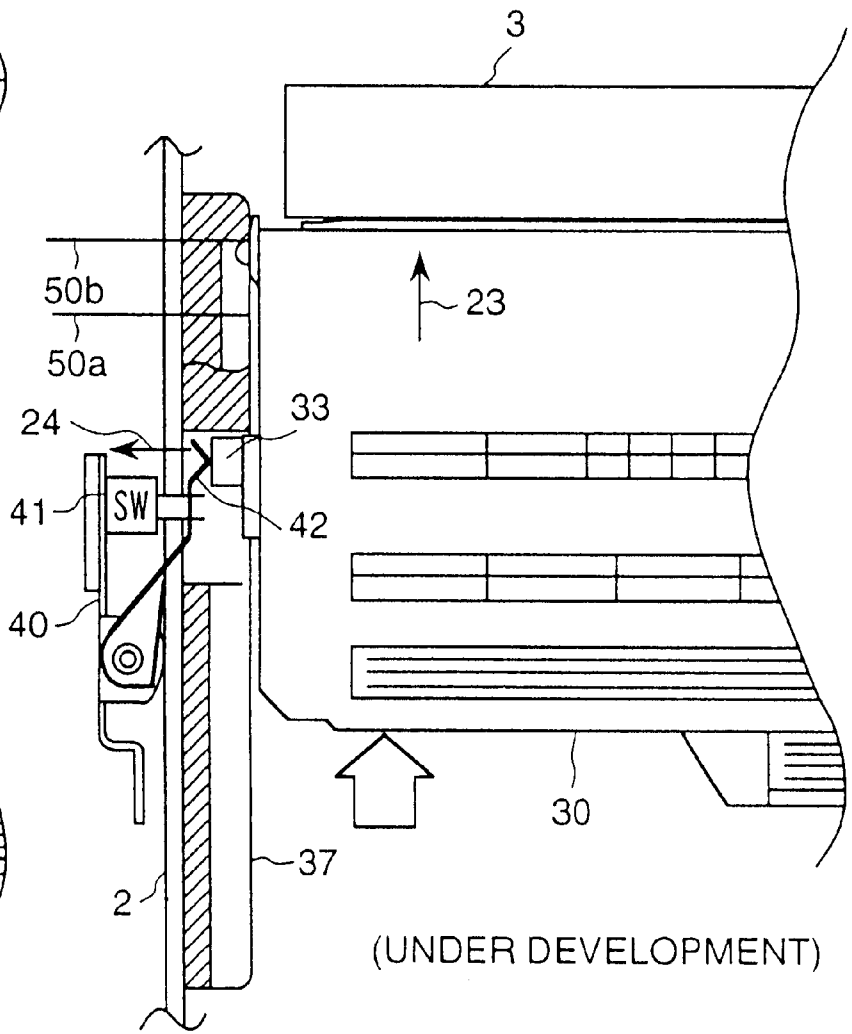
FIGS. 1A and 1B are plan views showing a developing device detector provided in the preferred embodiment of an image forming apparatus according to the present invention, in which operations of the developing device detector are illustrated, respectively, in the stand-by state of the developing device and in the developing state.
Figure 1A:
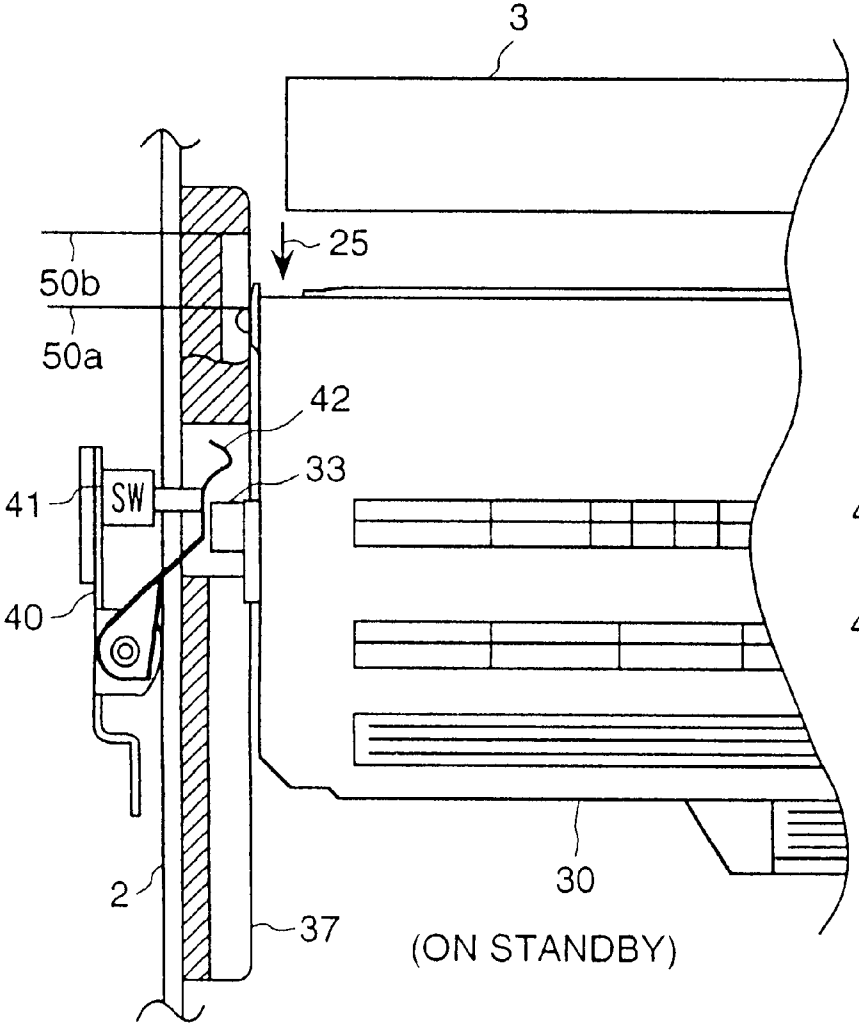

As shown in FIGS. 1A and 1B, based on the fact that the developing device 30 is moved from the developing device stand-by position 50*a* to the developing device operating position 50*b* in the direction shown by the arrow 23, toward the circulating photosensitive belt 3 for placing the developing device 30 into an operating position during warming up or developing, a detection device 40 is provided at a position where it will be operated by the customer key 33 at the developing device operating position 50*b*, but will not be operated by the customer key at the developing device stand-by position 50*a*.

When the developing device is moved to the operating position when it is operated, a lever 42 is rotated to actuate an electric signal transmitting switch 41, which is pushed in the direction of arrow 24, to vary an electric signal in the image forming apparatus 1. When the operation of the developing device 30 is completed, the developing device 30 is returned or retracted back to the developing device stand-by position 50*a*, and this causes the electric signal of the image forming apparatus 1 to return to its previous state before operation. In this way, even if the customer key 33 or the key 32 is removed from the developing device 30 which is loaded in the image forming apparatus 1, thereby removing the restriction provided by the guide 37, the electric signal transmission switch 41 will never be operated during operation of the developing device 30, and therefore will not produce the required electric signal in the image forming apparatus 1. Therefore, a judgment can be made that the developing device is not the proper kind of developing device 30 for use with the image forming apparatus 1, when the correct electric signal is not transmitted to the image forming apparatus 1 during operation of the developing device 30.

Figure 2A:
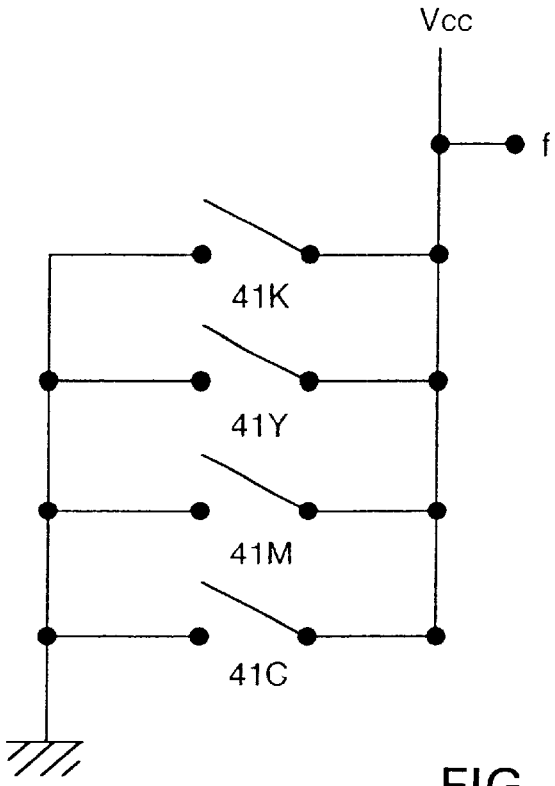
FIG. 2A is a schematic circuit diagram of parallel connection of the developing device detector provided in the preferred embodiment of the image forming apparatus according to the present invention.
Figure 2B:
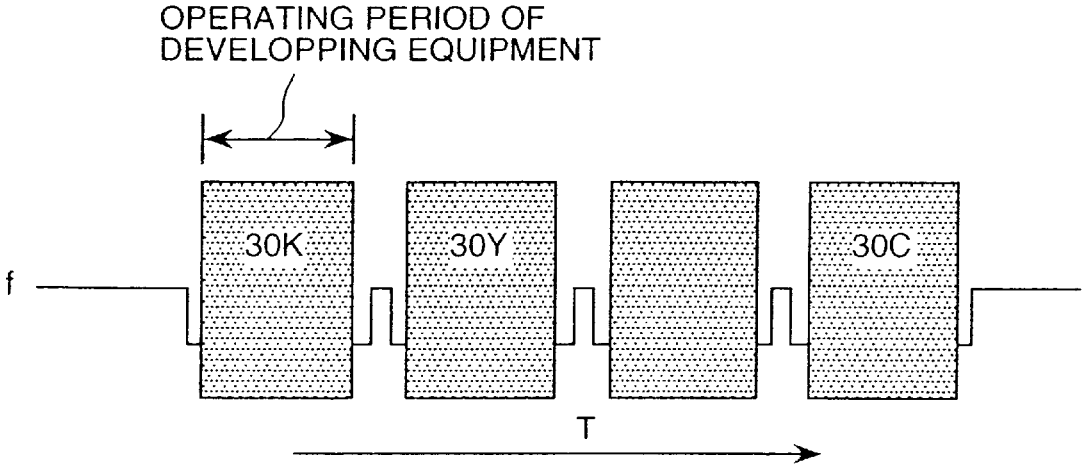
FIG. 2B is a diagram showing the variation of a signal at an output port.

For example, in case of an image forming apparatus in which the developing devices 30K, 30Y, 30M and 30C are loaded, when electric signal transmission switches 41K, 41Y, 41M and 41C are connected in parallel, as shown in FIG. 2A, and the developing devices 30 are operated in the sequential order of 30K, 30Y, 30M, 30C, the output signal f is varied as shown in FIG. 2B with the lapse of time. Therefore, by detecting a variation of the output signal f during a period from initiation of the developing operation to completion of development in all of the developing devices, correctly loaded developing devices and incorrectly loaded developing devices can be easily discriminated.

Figure 3:
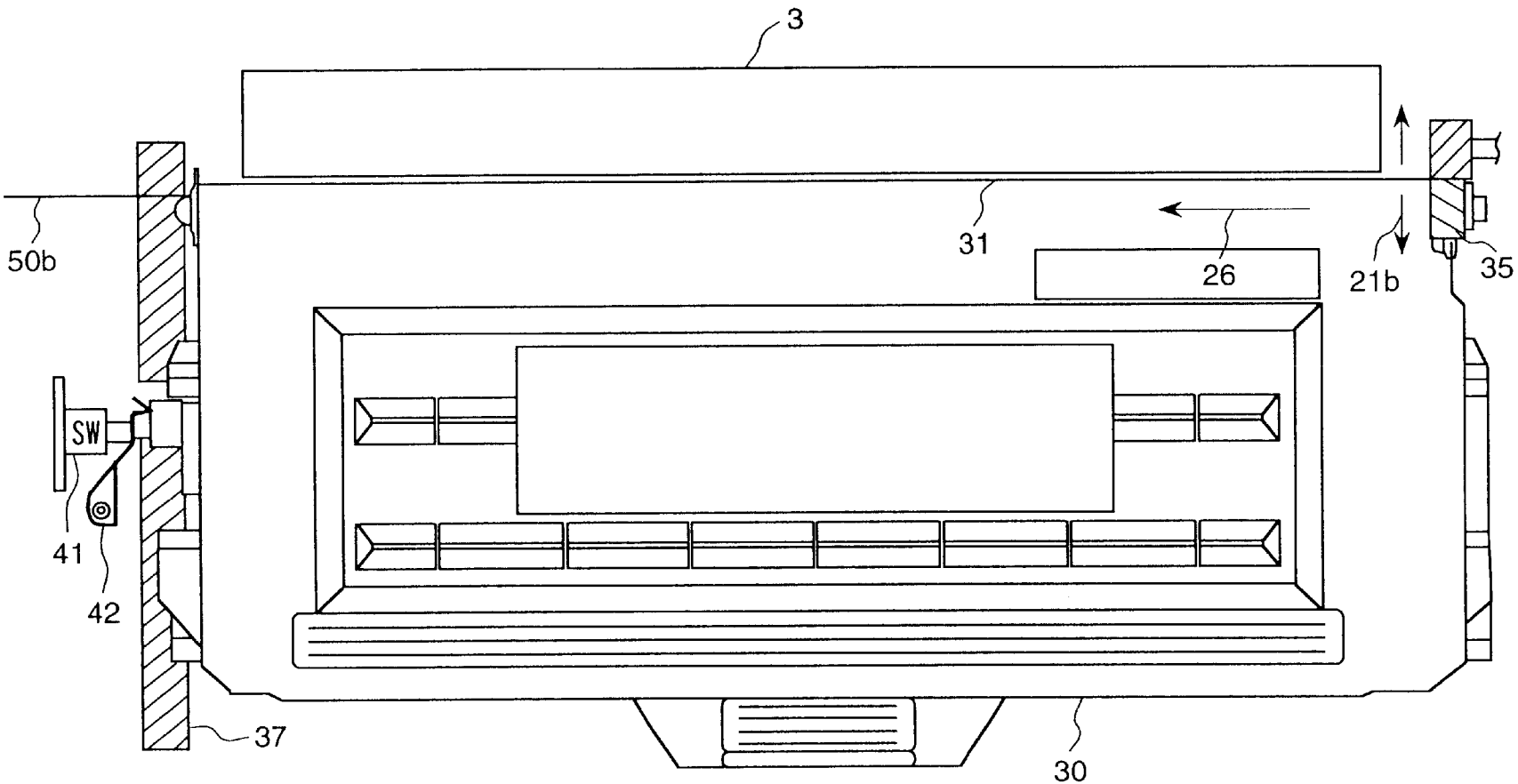
FIG. 3 is a plan view of an image forming apparatus showing a manner of operation of the developing device detector provided in the preferred embodiment according to the present invention.

In operation, as shown in FIG. 3, the developing device 30 supplies a thin layer of toner to the photosensitive belt 3 by driving a gear 5 installed on the right side of the toner carrier 31. At this time, for improvement of efficiency, a helical gear is employed to generate a thrust not only in gear rotating direction of arrow 21*b*, but also in the direction of arrow 26. By the thrusting force thus generated, the developing device is urged in the direction of arrow 26 upon driving of the gear 35 to eliminate a gap upon operation of the developing device 30 relative to the image forming apparatus 1, thereby to ensure operation of the electric signal transmission switch 41.

As set forth above, according to the present invention, an image forming apparatus which can detect the restricting means in operation can be provided. Furthermore, in the preferred embodiment, a detecting device for detecting the presence and absence of the developing device in the image forming apparatus, is provided with a construction that is not easily modified to allow the image forming apparatus to operate in a condition where the correct or required kind of developing device is not loaded.

Although the present invention has been illustrated and described with respect to an exemplary embodiment thereof, it should be understood by those skilled in the art that the foregoing and various other changes, omissions and additions may be made therein and thereto, without departing from the spirit and scope of the present invention. Therefore, the present invention should not be understood as limited to the specific embodiment set out above, but should be construed to include all possible embodiments which can be embodied within a scope encompassed and equivalents thereof with respect to the features set out in the appended claims.

What is claimed is:

1. A image forming apparatus comprising:

a latent image holding body on which an electrostatic latent image is formed;

a developing device developing said electrostatic latent image to produce a visible developed toner image, said developing device being detachably loaded in said image forming apparatus;

a transfer device transferring said developed toner image onto a printing medium;

a fixing device for fixing said transferred image;

a main body of said image forming apparatus incorporating at least said latent image holding body;

an engaging member mounted on one of said main body of said image forming apparatus and said developing device, identifying a kind of the developing device;

an engagement receptacle member mounted on the other of said main body of said image forming apparatus and said developing device, said engagement receptacle member being engageable with said engaging member when said developing device loaded in said image forming apparatus is other than a predetermined kind of developing device; and an electrical signal relaying member to be opened and closed by said engaging member during operation of said developing device.

2. An image forming apparatus comprising:

a latent image holding body on which an electrostatic latent image is formed;

a developing device developing said electrostatic latent image to produce a visible developed toner image, said developing device being detachably loaded in said image forming apparatus;

a transfer device transferring said developed toner image onto a printing medium;

a fixing device for fixing said transferred image;

means for preventing an incorrect developing device loaded in the image forming apparatus from being placed in a development enabled condition;

means for detecting an operating state of said preventing means; and a detecting device for detecting the presence or absence of a developing device in a redundant manner for restricting operation of said image forming apparatus under a non-loaded condition of the developing device.

3. An image forming apparatus comprising:

a latent image holding body on which an electrostatic latent image is formed;

at least one developing device developing said electrostatic latent image to produce a visible developed toner image, said developing device being detachably loaded in said image forming apparatus;

a transfer device transferring said developed toner image onto a printing medium;

a fixing device for fixing said transferred image;

means for preventing an incorrect developing device loaded in the image forming apparatus from being placed in a development enabled condition; and means for detecting an operating state of said preventing means;

wherein said detecting means is provided in a loading portion of said developing device in a main body of said image forming apparatus and is electrically opened and closed only upon operation of said developing device, and when said image forming apparatus is loaded with a plurality of said developing devices, said detecting means detects variation of one electric signal as output of a plurality of detecting means connected in parallel.

4. An image forming apparatus as set forth in claim 3, further comprising a plurality of said developing devices respectively holding a plurality of toners of mutually distinct colors, and said preventing means prevents loading of the developing device of a color other than a predetermined correct color.

* * * * *